US006000555A

United States Patent [19]

Anma

[11] Patent Number: 6,000,555

[45] Date of Patent: Dec. 14, 1999

[54] AUTOMATIC TRANSACTION APPARATUS AND HANDLING METHOD OF REJECTED BANKNOTES IN AUTOMATIC TRANSACTION APPARATUS

[75] Inventor: Hideyuki Anma, Tokyo, Japan

[73] Assignee: Kabushiki Kaisha Toshiba, Kawasaki, Japan

[21] Appl. No.: 08/675,770

[22] Filed: Jul. 3, 1996

[30] Foreign Application Priority Data

Jul. 7, 1995 [JP] Japan ..... 7-172503

[51] Int. Cl.[6] ..... B07C 5/00

[52] U.S. Cl. ..... 209/534; 209/900; 235/379

[58] Field of Search ..... 209/534, 552, 209/900; 902/12, 13; 235/379

[56] References Cited

U.S. PATENT DOCUMENTS

| | | | |
|---|---|---|---|
| 4,972,958 | 11/1990 | Ito et al. | 235/379 |
| 5,000,322 | 3/1991 | Goi | 209/534 |
| 5,522,511 | 6/1996 | Sakoguchi et al. | 902/12 X |
| 5,555,983 | 9/1996 | Yamagishi | 209/534 |

FOREIGN PATENT DOCUMENTS

| | | | |
|---|---|---|---|
| 4051391 | 2/1992 | Japan | 209/534 |

*Primary Examiner*—Tuan N. Nguyen

*Attorney, Agent, or Firm*—Pillsbury Madison & Sutro LLP

[57] ABSTRACT

An automatic transaction apparatus for performing a transaction process of banknotes, the apparatus includes a safe for storing banknotes to be transacted and an inspection unit for inspecting the banknotes taken out of the safe during the transaction process and banknotes stored in the safe during a checking process in which quantity of banknotes stored in the safe are counted to classify them into normal banknotes and rejected banknotes. The apparatus further includes a first and a second rejected banknote storage boxes for storing banknotes judged to be rejected by the inspection unit during the transaction process and the checking process and a controller for controlling to switch the first and the second rejected banknote storage boxes after completing the checking process to discriminate between a rejected banknote storage box storing banknotes judged to be rejected during the transaction process before the checking process and banknotes judged to be rejected during the checking process, and a rejected banknote storage box storing banknotes judged to be rejected during the transaction process after completing the checking process and banknotes judged to be rejected during the next checking process.

16 Claims, 10 Drawing Sheets

AUTOMATIC TRANSACTION APPARATUS AND HANDLING METHOD OF REJECTED BANKNOTES IN AUTOMATIC TRANSACTION APPARATUS

BACKGROUND OF THE INVENTION

1. Field of the Invention

The present invention relates to an automatic transaction apparatus which receives banknotes, classifies them into banknotes in reusable good condition and those not suited for reuse and stacks them separately and disperses reusable banknotes in response to customers' requests for dispensing.

2. Description of the Related Art

An automatic transaction apparatus which receives banknotes, classifies and stacks them into two groups of those in reusable good condition and those not suited for reuse and pays reusable banknotes in response to customers' requests for disbursement has been put in practical use.

This kind of automatic transaction apparatus includes a banknote receiving section, an inspection section, a recycling section, a rejection section, a loading section, a checking section and a conveying section. The banknote receiving section receives banknotes to be processed. The inspection section checks conditions of banknotes deposited into the receiving section; that is, for instance, the degree of stain or kind one by one and classify them into those banknotes that are reusable (hereinafter referred to as reusable banknotes) for disbursement and those that are judged to be not suited for reuse (hereinafter referred to as rejected banknotes). The recycling section stores reusable banknotes that are classified as such by the inspection section. The rejection section stores rejected banknotes that are classified as such by the inspection section. The loading section makes it possible to supply banknotes from the outside so that reusable banknotes to be disbursed in response to customers' requests do not become insufficient. The checking section rechecks the state of banknotes stored in the recycling banknote storage section for reuse one by one. The conveying section conveys banknotes deposited into the receiving section to the inspection section, guides the banknotes either to a recycle banknote stacking section or the rejected banknote storage section according to the result of classification by the inspection section and sends banknotes in specified numbers from the recycle banknote storage section to the receiving section.

Nowadays, the reduction of pause time, that is, improvement of the operating ratio of automatic transaction apparatus is demanded. For this reason, automatic transaction apparatus are required to have a capacity sufficient enough to store banknotes; that is, no additional replenishment of banknotes and reduction of the number of checks by service man are demanded for enabling unattended transaction for a long hour, for instance, in holidays. In addition, it is also demanded not to suspend normal transactions; that is, receiving or disbursing for supplying banknotes.

Further, one set of rejected banknote stacking sections is normally arranged in a relatively less storage capacity in order to secure a capacity of the banknote recycling section.

In the rejected banknotes stacking sections, rejected banknotes classified by the inspection section after deposited through the banknote receiving opening and counted, and rejected banknotes classified then disbursing from the recycling banknote section in response to customers' dispensing requests are stored.

Further, in the rejected banknote stacking section, rejected banknotes generated from the check for counting the balance of rejected banknotes stored in the recycling banknote section are also stored.

By the way, the balance of banknotes in the recycling banknote section becomes definite when completing the check but the balance in the rejected banknote stacking section is unknown. Therefore, in order to carry out the subsequent operation in the state where the balance of banknotes in an automatic transaction apparatus is settled by the check, newly rejected banknotes generated in the customers' transactions such as dispensing or depositing after completion of the check must be clearly discriminated from rejected banknotes already rejected before the check and rejected banknotes generated during the check.

Accordingly, the customers' transactions becomes executable after removing rejected banknotes stored in the rejected banknote stacking section by a clerk at the time when the check is completed. However, this has such a problem that a clerk is needed whenever performing the check. Further, there is also such a problem that a checking clerk must be on standby around an automatic transaction apparatus.

Further, nowadays, examples of some automatic transaction apparatus are installed in remote unattended shops through an on-line system. In addition, many automatic transaction apparatus are so formed that the check can be started any time according to a check command from a management sensor of an on-line system.

However, to automatically start the customer transactions after completing the check, rejected banknotes already stored in the rejected banknote stacking section must be removed.

This will bind a clerk who goes round unattended shops for a long hour and also increase the number of clerks required for going round a plurality of unattended shops.

SUMMARY OF THE INVENTION

It is an object of the present invention to provide an automatic transaction apparatus which is capable of reducing times required for a recovery work of rejected banknotes by clerks as well as improving utilizing efficiency of the apparatus for customers.

According to the present invention, an automatic transaction apparatus for performing a transaction process is provided, which comprising means for storing banknotes to be transacted; means for inspecting the banknotes taken out of the storing means during the transaction process and banknotes stored in the storing means during a checking process in which quantity of banknotes stored in the storing means are counted to classify them into normal banknotes and rejected banknotes; a first and a second rejected banknote storage boxes for storing banknotes judged to be rejected by the inspecting means during the transaction process and the checking process; and means for controlling to switch the first and the second rejected banknote storage boxes after completing the checking process to discriminate between a rejected banknote storage box storing banknotes judged to be rejected during the transaction process before the checking process and banknotes judged to be rejected during the checking process, and a rejected banknote storage box storing banknotes judged to be rejected during the transaction process after completing the checking process and banknotes judged to be rejected during the next checking process.

DETAILED DESCRIPTION OF THE PREFERRED EMBODIMENTS

Hereinafter, preferred embodiments of the present invention will be described referring to the attached drawings.

Figure 1:
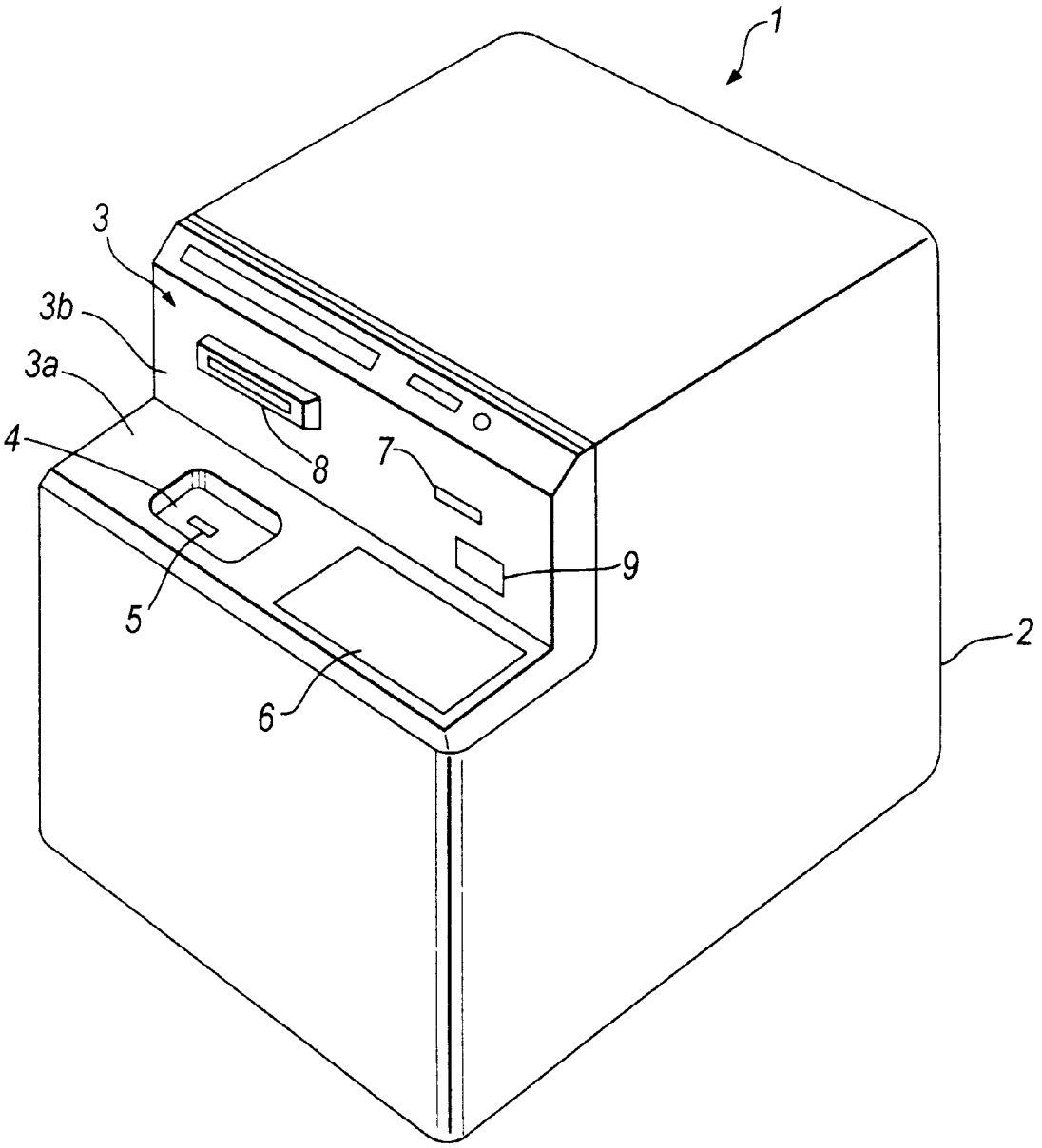
FIG. 1 is a perspective view showing the external view of an automatic transaction apparatus of the present invention.

FIG. 1 is a schematic diagram showing the exterior appearance of a depositing/dispensing apparatus as an automatic transaction apparatus of the present invention.

A depositing/dispensing apparatus 1 has a main body 2 as a housing and an operation panel 3 arranged on the front of the main body 2.

On a horizontal surface 3*a* of the operation panel 3, there is provided a banknote receiving/dispensing opening (the receiving section) 4. This banknote receiving/dispensing opening 4 is so formed that a number of banknotes P can be taken in or taken out in a lump.

Above the banknote receiving/dispensing opening 4, there is arranged a door 5 that can be opened/closed freely to prevent user's hand from being taken in and undesired foreign matters from being taken in while deposited banknotes P are taken in the main body 2 and dispensing banknotes P are conveyed to the banknote receiving/dispensing opening 4.

Further, there is a color CRT display 6 with touch sensors (not shown) incorporated integrally on the horizontal surface 3*a* of the operation panel 3.

The CRT display 6 displays the operational steps and other information on the CRT screen by illustrations, characters or words to guide a user and by sensing that display portions corresponding to user's secret identification number, amount of banknotes to be deposited or dispensed, account number, approval of transaction, confirmation or cancellation are pushed by touch sensors (not shown) and outputs corresponding signals to a main control unit (a controller) which will be described later.

Further, on a vertical surface 3*b* of the operation panel 3, there are provided a card insertion slot 7 into which a magnetic card (not illustrated, but conceptually shown in FIG. 2) as a transaction medium recorded with a secret identification number and account number is inserted, a passbook insertion slot 8 into which a passbook (not illustrated, but conceptually shown in FIG. 2) is inserted, and a coin receiving/dispensing opening 9 into which metal coins (conceptually shown in FIG. 2) are inserted.

Figure 2:
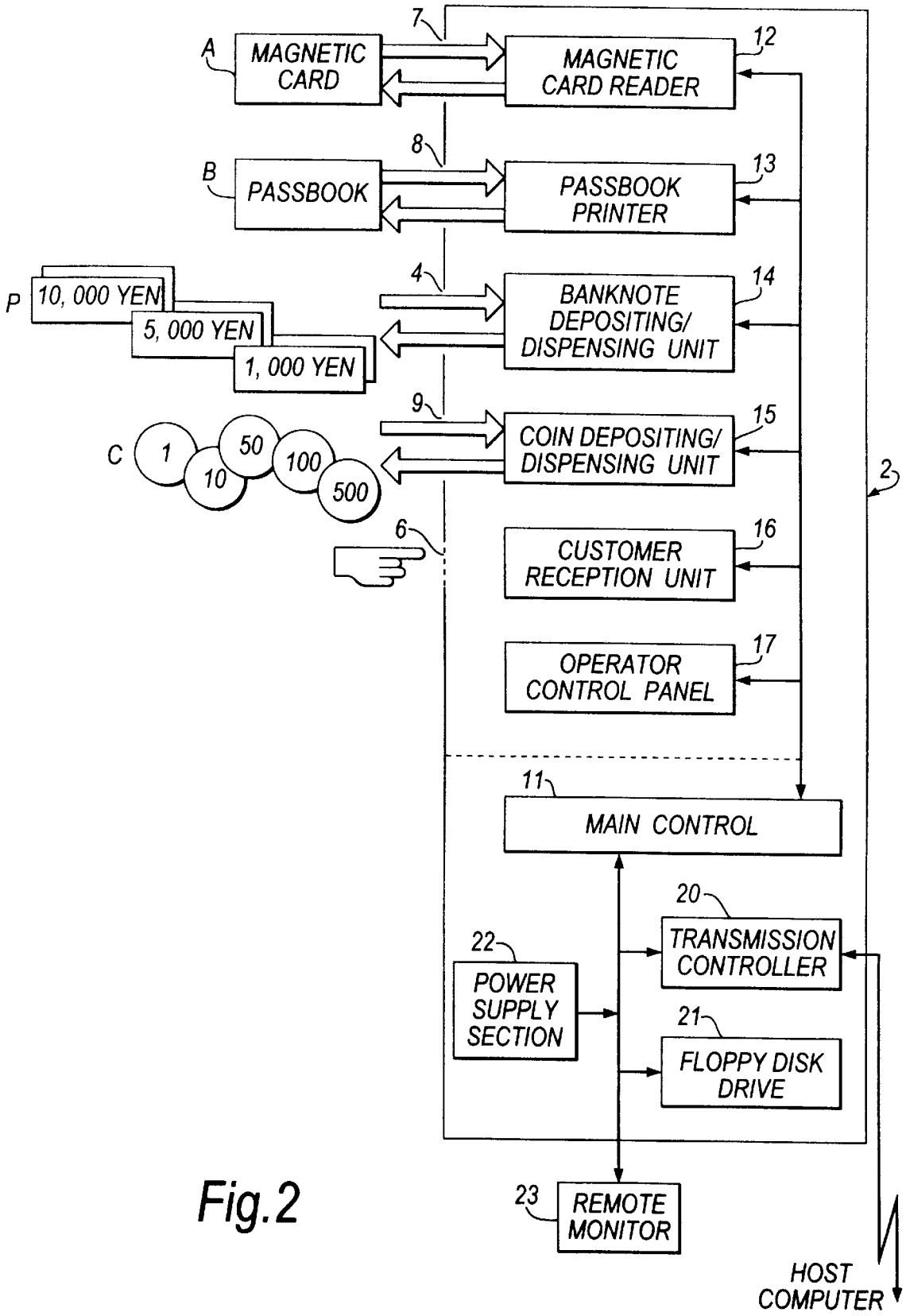
FIG. 2 is a block diagram showing one example of a control block of the automatic transaction apparatus shown in FIG. 1.

FIG. 2 shows a block diagram briefly showing internal components in the main body 2 of the deposition/dispensing apparatus 1 shown in FIG. 1 and the connections with corresponding control circuits.

As shown in FIG. 2, there are provided a main controller 11, a magnetic card reader 12 and a passbook printer 13. The main controller 11 controls the entirety of the apparatus. The magnetic card reader 12 takes in a magnetic card A inserted through the card insertion slot 7 and receives such account information as account number and kind from a magnetic stripe portion arranged at a specified position of the magnetic card A. The passbook printer 13 reads the magnetic stripe portion of a passbook B inserted through the passbook insertion slot 8 and records the contents of transaction on the passbook and a journal paper (not shown).

In the main body 2, there are also provided a banknote depositing/dispensing unit 14 and a coin depositing/dispensing unit 15. The banknote depositing/dispensing unit 14 conveys banknotes P to safes described later in the main body 2 according to a specified routine after taking in and counting banknotes P inserted from the outside through the banknote receiving/dispensing opening 4, and dispenses a designated quantity of banknotes P to the banknote receiving/dispensing opening 4. The coin depositing/dispensing unit 15 receives coins C put in the coin receiving/dispensing opening 9 and dispenses returns corresponding to the deposited coins and a designated quantity of coins C to the coin receiving/dispensing opening 9. In addition, in the main body 2, there are also provided a customer reception unit 16 comprising the CRT display 6 and an operator control panel 17 which has an internal monitor for use by clerk.

In the main body 2, there are also provided a transmission controller 20 which controls data transmission between the main controller 11 and a host computer (not shown), a floppy disk driver 21 for receiving and reading a floppy disk (not shown) as a data file recorded with information on financial organizations required for transfer transaction, for instance, bank names and branch names in the order of 50 Japanese KANA syllabary, and a power supply section 22.

Further, the main controller 11 is connected to a remote monitor 23 provided at the outside for use by a clerk. The balance of banknotes P held in the main body 2 and such processes as the exchange (or supply) of banknote loading box that will be described later, supply of journal paper, etc. are instructed by the operator control panel 17 and the remote monitor 23.

Figure 3:
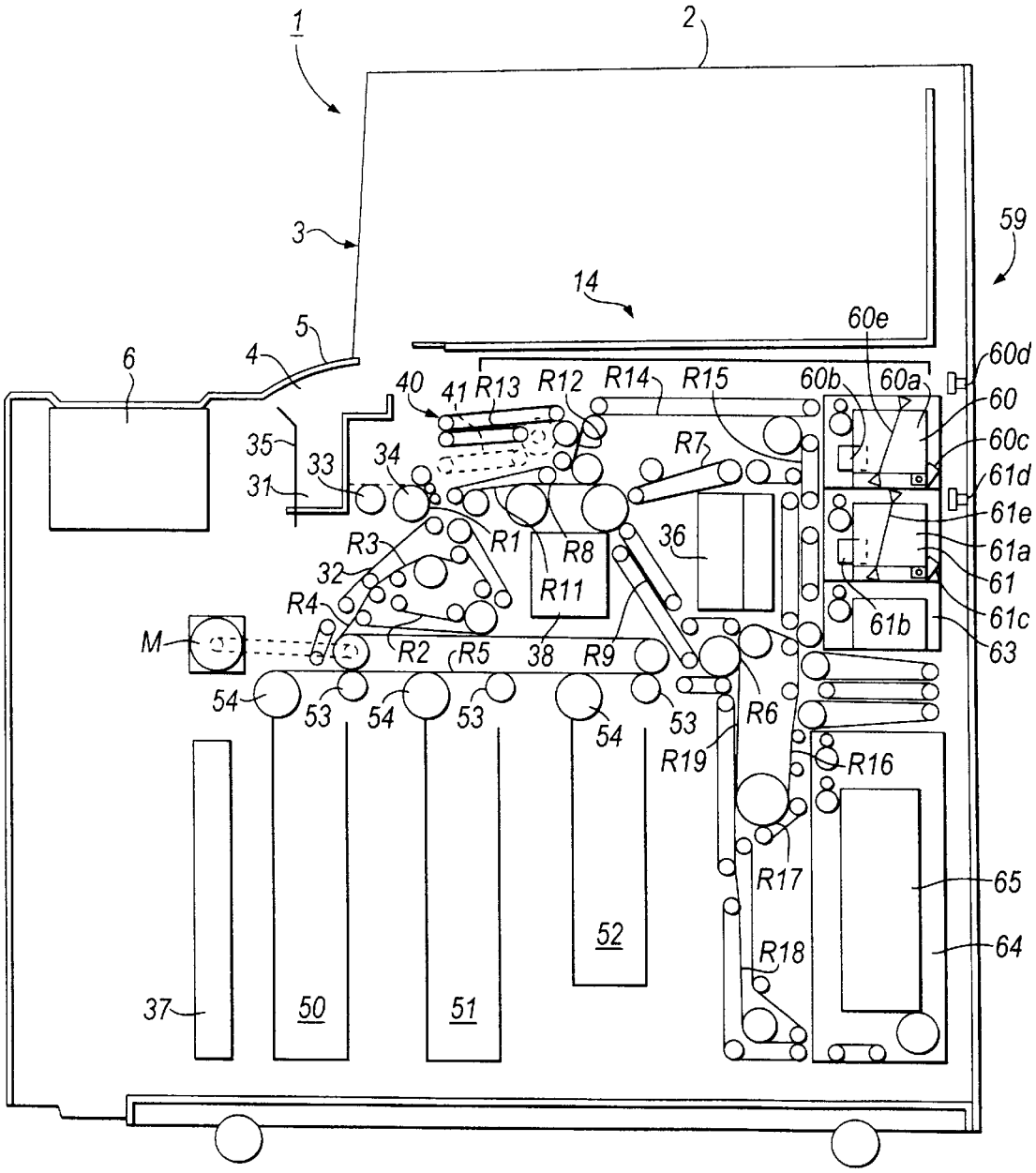
FIG. 3 is a perspective side view of the automatic transaction apparatus shown in FIG. 1.

Then, the deposition/dispensing unit will be explained referring to FIG. 3. FIG. 3 is a schematic perspective view of the depositing/dispensing apparatus 1 shown in FIG. 1 viewed from the side.

In FIG. 3, there is arranged the banknote depositing/dispensing unit 14 at the center in the main body 2. In FIG. 3, the banknote receiving/dispensing opening 4 is positioned in the direction of the customer reception panel 14 (the upper left direction in the figure).

Under the banknote receiving/dispensing opening 4, there is arranged a banknote storage chamber (hereinafter referred to as a hopper) 31 to store banknotes P deposited in the banknote receiving/dispensing opening 4.

Under the hopper 31, there are provided a banknote front & back side sorter 32 to sort the front and back sides of banknotes and a take-out roller 33 and a take-out unit 34 to guide banknotes P one by one to the banknote front & back side sorter 32.

Further, on one wall surface (the left side in FIG. 3) of the hopper 31, there is a back-up plate 35 which is movable in parallel with the opposite wall surface (the right side in FIG. 3). The back-up plate 35 is able to change the capacity of the hopper 31 by moving to a specified position. Further, this back-up plate 35 is used as a pressurizing member to push banknotes P against the take-out roller 33 side.

The hopper 31 is in the direction where banknotes are set upright when user puts banknotes P in the hopper and banknotes P are dispensed to user and rotates by 90 degree in the direction where banknotes P are set horizontally when banknotes P are taken in the storage section in the main body 2 and banknotes P are dispensed into the hopper 31.

On the inner side surface (the right direction in FIG. 3) of the banknote depositing/dispensing unit 14, there is provided an inspection unit 36 which checks banknotes P one by one for kind, overlapped conveyance, stain, front and back sides and tear and classifies them into reusable banknotes (hereinafter referred to as recycle banknotes) for dispensing and those judged not suitable for reuse (hereinafter referred to as rejected banknotes).

Further, in the front of the banknote depositing/dispensing unit 14, there is provided a controller 37 housing the main controller 11 and the transmission controller 20 which are already explained referring to FIG. 2.

At the center of the banknote depositing/dispensing unit 14, there is provided a received banknote temporary stacking section 38 which retains banknotes P deposited into the hopper 31 of the banknote receiving/dispensing opening 4 temporarily.

Between the received banknote temporary stacking section 38 and the hopper 31, there is provided a rejected banknote stacking section 40 for temporarily stacking banknotes rejected by the inspection by the inspection unit 36 and returning them to the hopper 31 at a prescribed timing.

The rejected banknote stacking section 40 has a conveyor belt 41 that is formed so as to move up when returning rejected banknotes and returns rejected banknotes P to the hopper 31 by a rejected banknote convey path that is formed by the conveyor belt 41 as it moves up at the time when all banknotes P deposited in the hopper 31 are inspected by the inspection unit 36 during the "Banknote Depositing" operation that is described later.

At the location below the banknote depositing/dispensing unit 14 and nearly at the center of the main unit 2, a first safe 50, a second safe 51 and a third safe 50 are arranged in order from the hopper 3 side. Further, large nomination banknotes, for instance, ¥10,000 banknotes are normally stored in the first safe 50 and the second ¥1,000 banknotes are stored in the third safe 52. Further, ¥5,000 nomination bank-notes are not used in the ordinary customer transactions and therefore, they are stored in the rejected banknote safe which is described later regardless of the inspection result by the inspection unit 36.

The first through the third safes 50 through 52 have a banknote take-in device 53 and a banknote take-out device 54, respectively on the top so as to make it possible to take in banknotes P deposited by users and dispense banknotes in prescribed numbers in response to dispensing requests of users. That is, the first through the third safes 50 through 52 are used as the banknote recycle safes for dispensing ¥1,000 and ¥10,000 banknotes deposited by users for dispensing, while receiving and storing banknotes required for dispensing from the banknote loading safe that is described later.

Further, a motor M for driving various driven elements such as conveyor belts or rollers in the main body 2 and a driving power transmission system (not shown) to transmit driving power generated by the motor M to the conveyor belts or rollers are provided in the customer reception panel direction (the left direction in FIG. 3) of the banknote depositing/dispensing unit 14. Further, a plurality of banknote convey paths R1 through R9 and R11 through R19 are formed by such driven elements as conveyor belts and rollers. In addition, at the locations where the conveyor paths R1 through R9 and R11 through R19 are branched, a switching unit (not shown) is provided.

At the inner upper part (the right direction in FIG. 3) of the banknote depositing/dispensing unit 14, there is arranged a rejected banknote stacking section 59 to stack rejected banknotes, which will be described later.

The rejected banknote stacking section 59 has a first and a second rejected banknote storage boxes 60 and 61 which are laid one on another in the vertical direction. The first and the second rejected banknote boxes 60 and 61 store rejected banknotes guided according to the classification condition instructed by a host computer (not shown) connected via the transmission controller 20 or the operator control panel 17.

Rejected banknote cassettes 60*a* and 61*a* that are formed detachably are stored in respective rejected banknote storage boxes 60 and 61. Respective rejected banknote cassettes 60*a* and 61*a* are provided with a marker (not shown), for instance, a magnet, notch or projection at their prescribed positions for inputting the existence of respective cassettes to a cassette sensor shown below. Further, the first and the second rejected banknote cassettes 60*a* and 61*a* are formed substantially in the same shape so that they are interchangeable.

The first and the second rejected banknote storage boxes 60 and 61 have cassette detecting sensors 60*b* and 61*b* incorporated at the prescribed positions to detect whether corresponding rejected banknote cassettes 60*a* and 61*a* are set in respective storage boxes. The cassette detecting sensors 60*b* and 61*b* output prescribed output signals by detecting a maker provided at the prescribed position of respective rejected banknote cassettes 60*a* and 61*a* when rejected banknote cassettes are set in respective rejected banknote storage boxes. For the cassette detecting sensors 60*b* and 61*b*, in consonance with the characteristic and shape of the maker formed on a corresponding rejected banknote cassette, for instance, a Hall element to detect magnetic force from a magnet, a contact type switch formed in the shape matched to a notch, a non-contact switch which is comprised of light emitting section and a light receiving section and operates when the light from the light emitting section is intercepted by the projection and the like are used.

The rejected banknote storage boxes 60 and 61 are provided with lock keys 60*c* and 61*c* at prescribed positions to lock the storage boxes so as not to take out the rejected banknote cassettes stored in the respective storage boxes. For the lock keys 60*c* and 61*c*, for instance, a mechanical cylinder type lock key that can be unlocked by an exclusive key only or an electric type lock key that can be unlocked by inputting a secrete identification number, etc. are used. Further, when an electric type key is used, respective keys 60*c* and 61*c* may be controlled by a specific password instructed by a host computer (not shown) connected via the transmission controller 20 or the operator control panel 17.

In the area at the outside and near the first and the second rejected banknote storage boxes 60 and 61 and exposed to the outside when a rear door (not shown) is opened, indicators 60*d* and 61*d* are provided, which indicate the rejected banknote storage boxes storing rejected banknotes guided before completing the inspection and the rejected banknote storage box storing rejected banknotes generated in the main unit after the inspection and rejected banknotes generated in the customer transaction after the inspection in the recognizable manner that will be described later. The indicators 60*d* and 61*d* are comprised of a pair of "RED" and "BLUE" lamps, and the lamps capable of indicating the characters "After Inspection" and "Before Inspection" or "Before Count" and "After Count" lamps. The indicators 60*d* and 61*d* may be LEDs incorporated in, for instance, the prescribed positions of the operator control panel 17 or the remote monitor 23. The indicators 60*d* and 61*d* inform the outside; that is, a touring clerk of the rejected banknote storage box storing rejected banknotes generated up to the completion of inspection that will be described later according to the classification condition instructed by a host computer (not shown) connected via the transmission controller 20 or the operator control panel 20.

In the first and the second rejected banknote storage boxes 60 and 61, banknote sensors 60*e* and 61*e* are arranged to detect the existence of banknotes P in the rejected banknote cassettes stored in the these boxes. The banknote sensors 60*e* and 61*e* use, for instance, non-contact sensors of which light emitting section and light receiving section are arranged at the outside of the rejected banknote cassettes and sense the existence of banknotes in the bank-note cassettes according to whether the light emitted from the light emitting section is sensed by the light receiving section.

Under the second rejected banknote storage box 61, there is provided a recovering section 63 to retain banknotes which are failed by users to take out of the hopper 31.

Under the recovering section 63, there is provided an auxiliary safe 64 that is used as a loading cassette to supply banknotes for dispensing from the outside. The auxiliary safe 64 has a loading cassette 65 that is detachably formed to make it possible to supply banknotes P from the outside without being restricted by the banknote P conveying action to the banknote receiving/dispensing opening 4 for receiving or dispensing banknotes P from the banknote receiving/dispensing opening 4 when required.

Next, various processes of banknotes P by the depositing/dispensing apparatus 1 and the internal operation of the main body 2 will be described.

Rejected banknotes will be described in detail in the following.

Rejected banknotes may be classified as follows:

1) Banknotes which are deposited in the customer transactions, classified, rejected and separated from reusable banknotes in good condition by the inspection unit 36; that is, banknotes which are remarkably contaminated or damaged and to be returned to customers (rejected banknotes);
2) Banknotes that are deposited, judged once more by the inspection unit 36 and classified as being remarkably contaminated or damaged and not countable because more than two banknotes are conveyed in overlapped state when storing in the recycling section (rejected banknotes before the check);
3) Banknotes that are deposited but not used for dispensing; that is, ¥5,000 banknotes (rejected banknotes);
4) Banknotes judged to be uncountable (rejected banknotes) because, for instance, more than two banknotes are conveyed in the overlapped state when dispensing from the first through the third safes 50 through 52 (rejected banknotes);
5) Banknotes judged to be uncountable during the process when banknotes are guided from respective safes to the auxiliary safe 64 because, for instance, more than two banknotes are conveyed in the overlapped state (rejected banknotes before the dispensing);
6) Banknotes that are judged to be uncountable because more than two banknotes are conveyed in the overlapped state in the process to return from the auxiliary safe 64 to respective safes in the check that will be described later (rejected banknotes during the check);
7) Rejected banknotes which are rejected in the dispensing from the first through the third safes 50 through 52 after the dispensable balance of banknotes by the number of recycle banknotes returned to the safes 50 through 52 by the check that will be described later (rejected banknotes after the check);
8) Rejected banknotes newly generated from the transactions with customers after the completion of check that will be described later (rejected banknotes after the check).

As already described above, newly rejected banknotes during the transactions with customers such as dispensing or depositing after completion of the check (that is, rejected banknotes for dispensing after the check and rejected banknotes received after the check) must be clearly discriminated from banknotes rejected before and during the check.

Next, the flow of banknotes when deposited will be described.

Deposition

Figure 4:
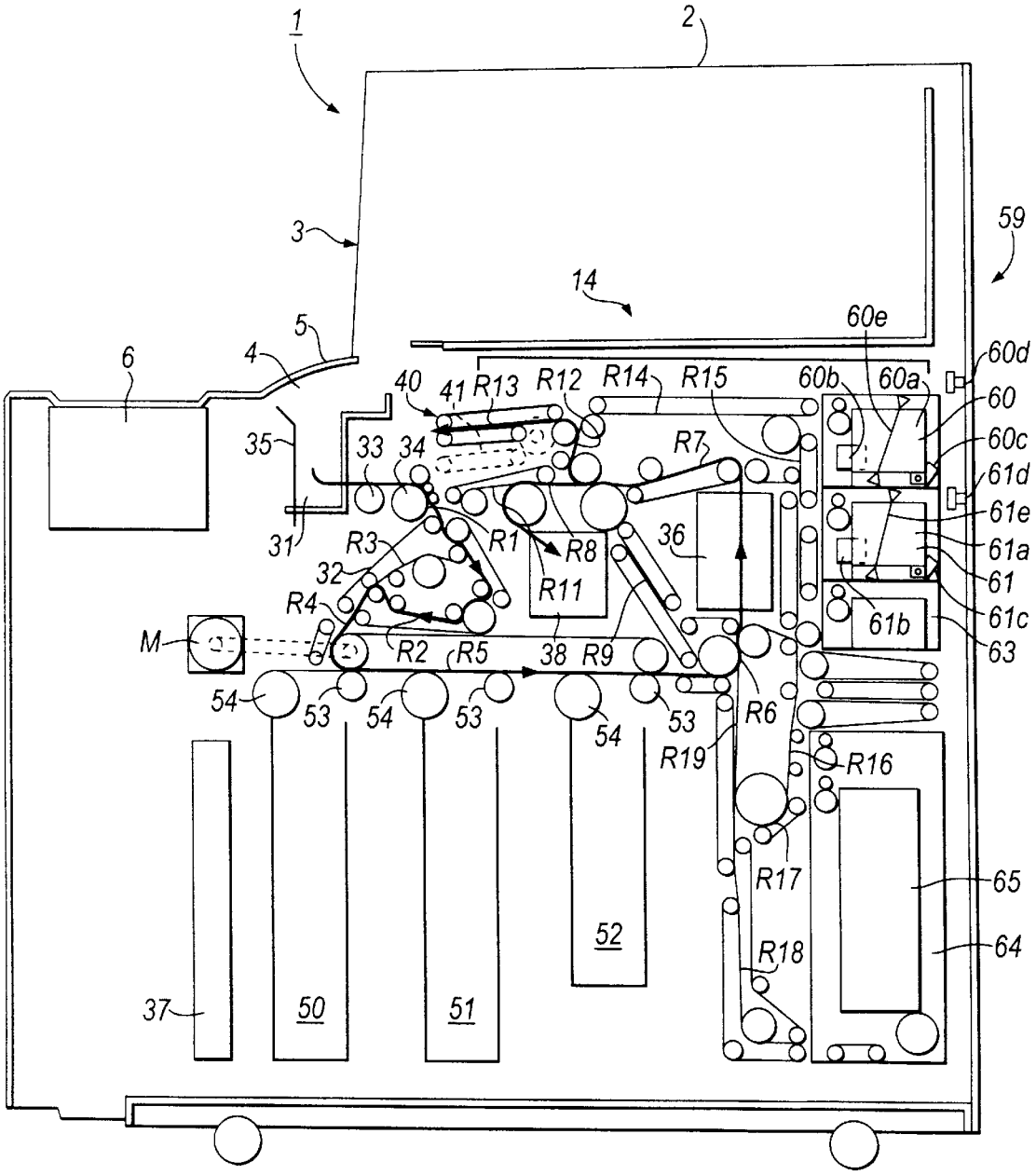
FIG. 4 is a schematic diagram showing the flow of bank-notes when deposited into the automatic transaction apparatus shown in FIG. 3.
Figure 5:
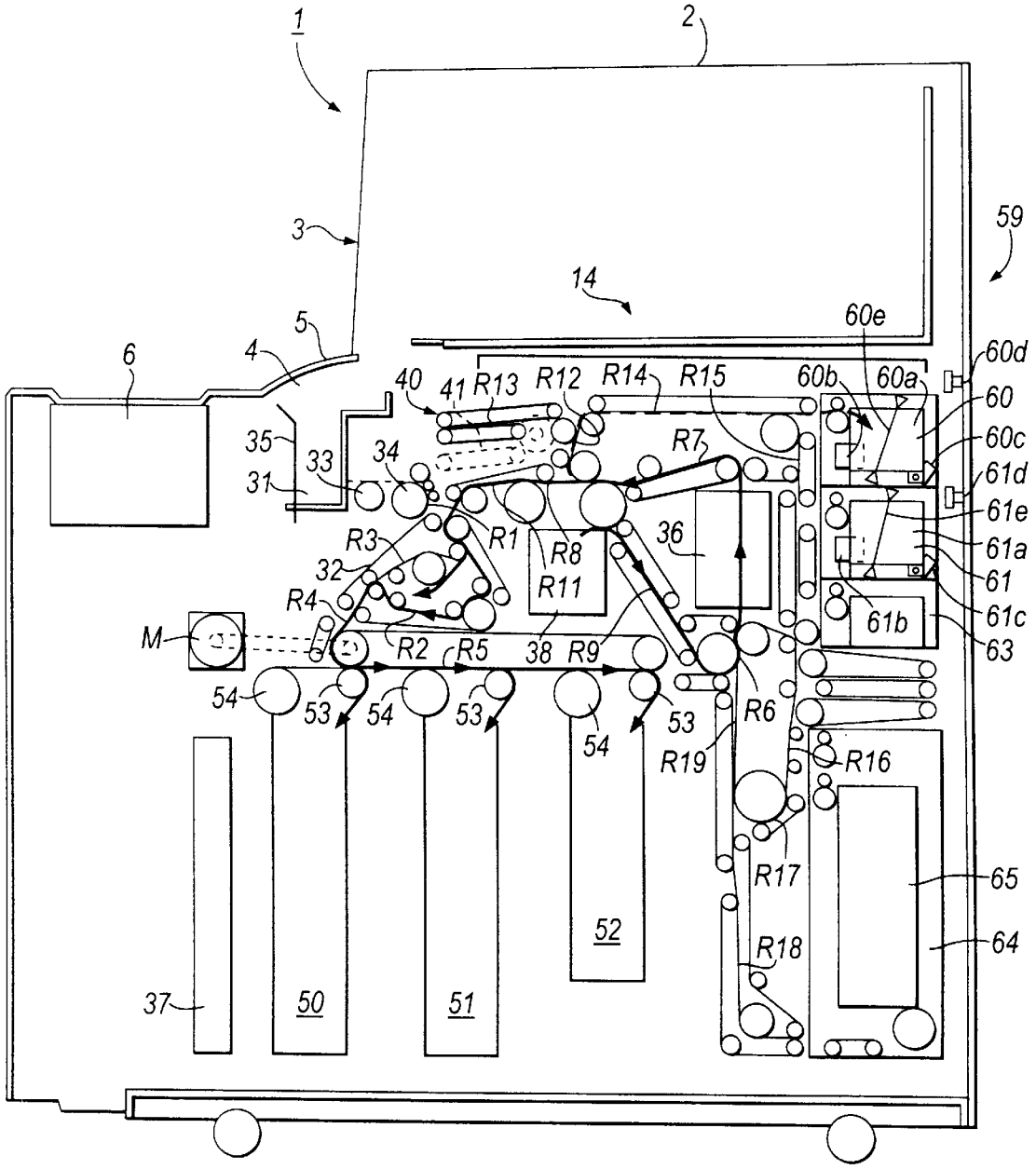
FIG. 5 is a schematic diagram showing the flow of bank-notes following the flow of banknotes when deposited into the automatic transaction apparatus shown in FIG. 4.

FIG. 4 and FIG. 5 are the schematic diagrams showing the flow of banknotes when they are deposited in the depositing/dispensing apparatus 1. Further, FIG. 5 shows the flow of banknotes following the flow of banknotes shown in FIG. 4.

In FIG. 4, banknotes P are led to the received banknote temporary stacking section 38 via the convey path R1, the front sided banknote convey path R2 and the convey paths R4 through R8 of the front & back sided banknote sorter 32 as shown by the solid line with arrow marks.

Unreadable banknotes P (banknotes to be returned; that is, rejected banknotes) that couldn't read by the inspection unit 36 provided in the convey path R6 are branched at the convey path R12 as shown by the broken line with arrow marks, led to the rejected banknote stacking section 40 and are once stacked in this section.

After all banknotes P deposited in the hopper 31 are inspected by the inspection unit 36, the rejected banknotes P stacked in the rejected banknote stacking section 40 are returned collectively to the hopper 31 at a prescribed timing by the convey path 13 that is formed when the conveyor belt 41 is raised. In this case, the door 5 is opened by the control or the main controller 11 and a message demanding a user to deposit banknotes again is displayed on the CRT display 6.

If all banknotes P could be read by the inspection unit 36, a deposited amount is displayed on the CRT display 6 by the control of the main controller 11.

When a user (customer) checks the deposited amount and pushes the touch sensor indication "CONFIRM" on the CRT display 6 if it is proper, the banknotes P stacked temporarily in the received banknote stacking section 38 are conveyed to the recycle storage boxes; that is, the first through the third safes 50 through 52 one by one via the convey paths R9, R6, R7, R8, R11 and R1 through R4 as shown by the solid lines with arrow marks in FIG. 5.

The banknotes P conveyed to the first through the third safes 50 through 52 are stored in the first safe 50 or the second safe 51 and the third safe 52 by every kind of bank-note via a switching gate (not shown), which is selectively operated by the control of the convey path R5 and the main controller 11, and a banknote take-in device 53 and a bank-note take-out device 54 arranged corresponding to respective safes.

At this time, ¥5,000 banknotes (exclusive banknotes) that are not used for dispensing and rejected banknotes that are rejected when passed again through the inspection unit 36 (the conveyor path R6) and rejected before the execution of the check described later; that is, rejected banknotes before the check are stored in the rejected banknote cassette 60*a* of either the first and the second rejected banknote storage boxes 60 and 61 (here, the first rejected banknote storage box 60) which is pre-decided by the instruction from a host computer (not shown) connected via the transmission controller 20 or the operator control panel 127 as shown by the broken line. Further, an indicator 60*d* is turned ON by the control of the main controller 11 to indicate that the rejected banknote storage box (here, the first rejected banknote storage box 60) storing at least ¥5,000 banknotes designated by the instruction from a host computer connected via the transmission controller 20 or the operator control panel 17 is under use at present.

On the other hand, when passed through the inspection unit 36 (the convey path R6) again, banknotes may be rejected and banknotes deposited newly after the check which will be described later also may be rejected. These bank-notes rejected after the check are stored in an unused rejected banknote storage box (a rejected banknote storage box storing ¥5,000 banknotes that are not used for dispensing) out of the first and the second rejected banknote storage boxes 60 and 61 likewise the banknotes rejected after the check which will be described using FIG. 8; that is, a rejected banknote storage box (here, the second rejected banknote storage box 61) which is decided in advance by the instruction from a host computer connected via the transmission controller 20 or the operator control panel 17.

If banknotes P returned to the hopper 31 as rejected banknotes by the inspection unit 36 are not taken out of the hopper 31 by a user even after a prescribed time passed in the deposition operation described above, these banknotes are judged to be "failed to be taken out" by the control of the main controller 11 and stored in the recovering section 63. In this case, the rejected banknotes returned to the hopper 31 are guided to the convey path R1 one by one by the take-out roller 33 and conveyed to the recovering section 63 through the convey paths R2, R4–R7, R12, R14 and R15.

Further, in an automatic transaction apparatus in which banknotes temporarily stored in the received banknote temporary stacking section 38 are stored in the recycle banknote storage box without passing through the inspection unit 36 again after classification into rejected banknotes (returning banknotes) and exclusive banknotes by the inspection unit 36, the embodiment of this invention described above is also applicable when ¥5,000 banknotes (exclusive banknotes) that are not used for dispensing are routed to either the first and the second rejected banknote storage boxes; for instance, to the first rejected banknote storage box.

Next, the flow of banknotes during the dispensing will be described.

Dispensing

Figure 6:
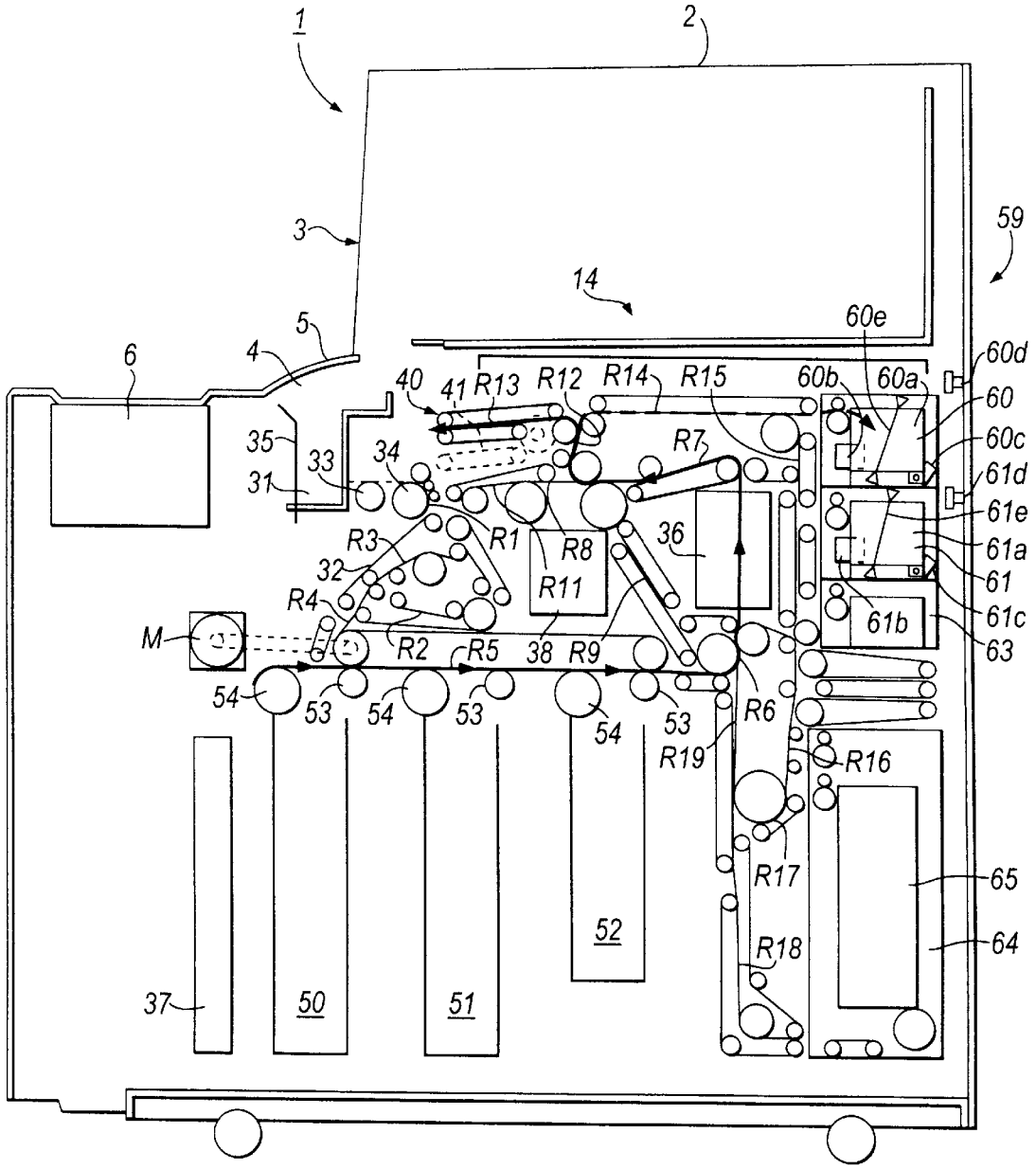
FIG. 6 is a schematic diagram showing the flow of bank-notes when dispensing in the automatic transaction apparatus shown in FIG. 3.

FIG. 6 is a perspective side view of the depositing/dispensing apparatus showing the flow of banknotes during the dispensing.

When a user (a customer) inserts a magnetic card A into the card insertion slot 7 of the operation panel 3, a message asking input of a secrete identification number and the numerical keys of "0" through "9" that are used to input signals corresponding to these numerals are displayed on the CRT display 6 by the control of the main controller 11.

When a user input his secrete identification number, this ID number is transmitted to a host computer (not shown) by the control of the transmission controller 20 and is collated with the secrete ID number stored in the host computer by the host computer.

If the input secrete ID number is correct, a message to accept a dispensing request is displayed on the CRT display 6 by the control of the main controller 11.

Under this state, the dispensing request by a user is authorized, a message asking input of a dispensing amount, numerical keys for use to input signals corresponding to numerals "0" through "9", and the control key for use to input a signal corresponding to a prescribed control key that is used to confirm the condition are displayed on the CRT display 6.

When a user inputs a dispensing amount, the banknote take-out device 53 and the banknote take-in device 54 which are arranged in the first safe 50 or the second safe 51 and the third sage 52, respectively are selectively energized by the control of the main controller 11, and banknotes in the number of sheets corresponding to a demanded amount are taken out of the safes 50 through 52 and guided to the convey path R5.

Banknotes in the prescribed number of sheets guided to the convey path R5 are conveyed through the convey paths R6, R7, R12 and R13, and supplied to the hopper 31. In succession, when the door 5 of the banknote receiving/dispensing opening 4 is opened, a message asking to take the banknote out of the hopper 31 is displayed on the CRT display 6.

Further, when dispensing banknotes, rejected banknotes of which number of sheets was not judged by the inspection unit 36 because more than two sheets were conveyed in the overlapped state and rejected banknotes damaged by the belts or the rollers in the main body and generated when the balance of recycle banknotes stored in the safes 50 through 52 is not decided by the check that is described later (rejected banknotes when dispensing) are stored in the rejected banknote cassette 60*a* of either one of the first and the second rejected banknote storage boxes 60 and 61, which are decided in advance by the instruction from a host computer connected via the transmission controller 20 or the operator control panel 17 and already storing ¥5000 banknotes (in this case, the first rejected banknote storage box). In this case, the "RED" or "BEFORE CHECK" lamp of the indicator 60*d* provided at the outside and near the first rejected banknote storage box 60 is turned ON by the control of the main controller 11 to indicate that exclusive banknotes and dispensing rejected banknotes are stored in the first rejected banknote storage box 60.

On the other hand, rejected banknotes of which number of sheets could not be judged or damaged by the belts or rollers in the main body 2 and generated from the dispensing when the balance of recycle banknotes stored in the safes 50 through 52 are not decided by the check described later (rejected banknote after the check) are stored in a rejected banknote storage box; that is, the second rejected banknote storage box 61 here, which is an unused rejected banknote storage box (storing no ¥5000 banknote that is not used for dispensing) of either the first and the second rejected banknote storage boxes 60 and 61 and decided in advance by the instruction from a host computer connected via the transmission controller 20 or the operator control panel 17 likewise rejected banknotes for dispensing after the check that is described later referring to FIG. 8.

In the dispensing operation described above, if banknotes P supplied in the hopper 31 for dispensing are not taken out of the hopper 31 by user even after a prescribed time was passed, it is judged as "Failed To Take Out" by the control of the main controller 11 and the banknotes are stored in the recovering section 63. In this case, rejected banknotes temporarily returned to the hopper 31 are taken out from the hopper 31 and guided to the convey path R1 one by one by the take-out roller 33 and conveyed through the convey paths R2, R4–R7, R12, R14 and R15 and are guided to the recovering section 63.

Next, the flow of banknotes during the check will be described.

Check

Figure 7:
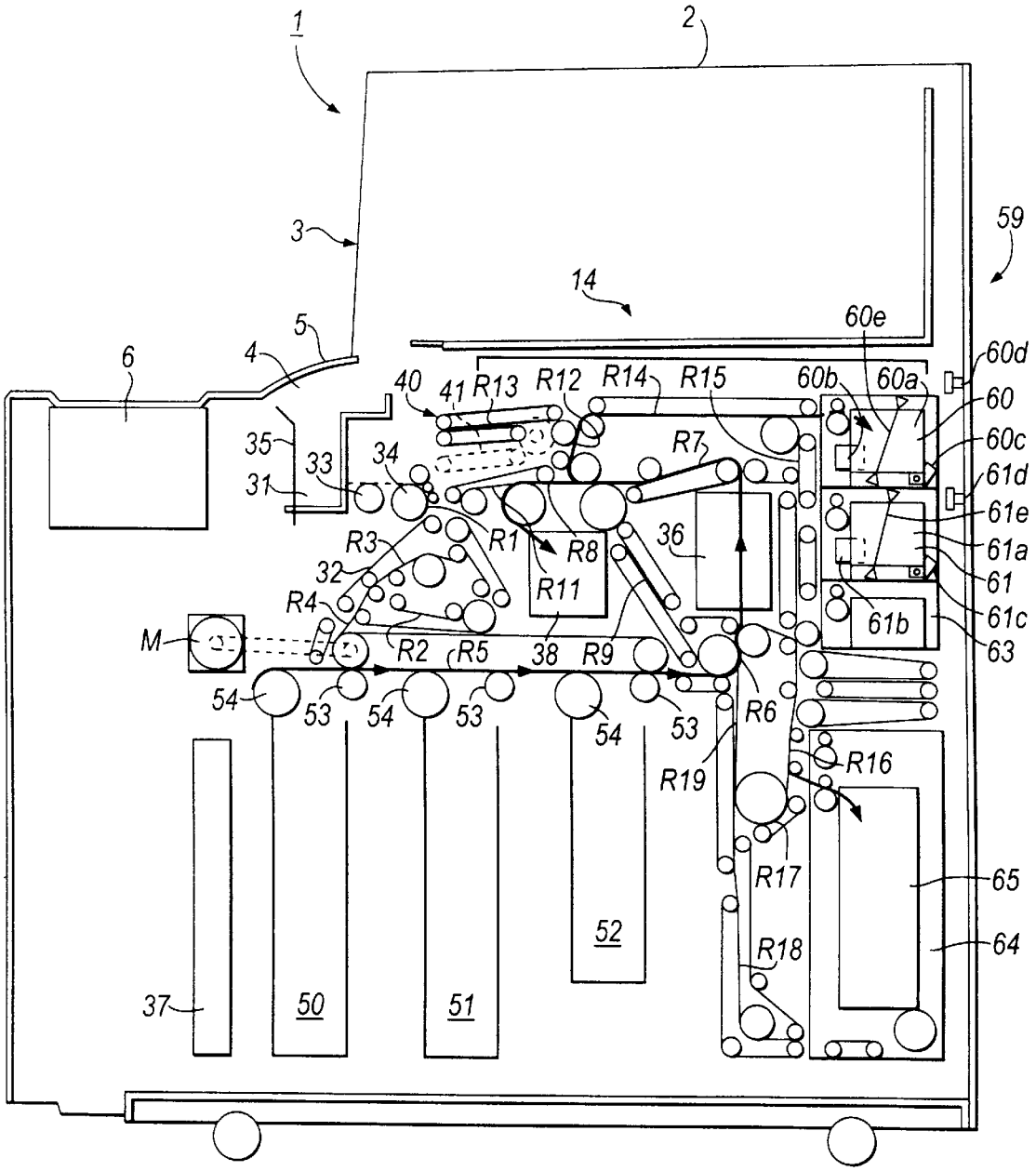
FIG. 7 is a schematic diagram showing the flow of bank-notes during the checking in the automatic transaction apparatus shown in FIG. 3.
Figure 8:
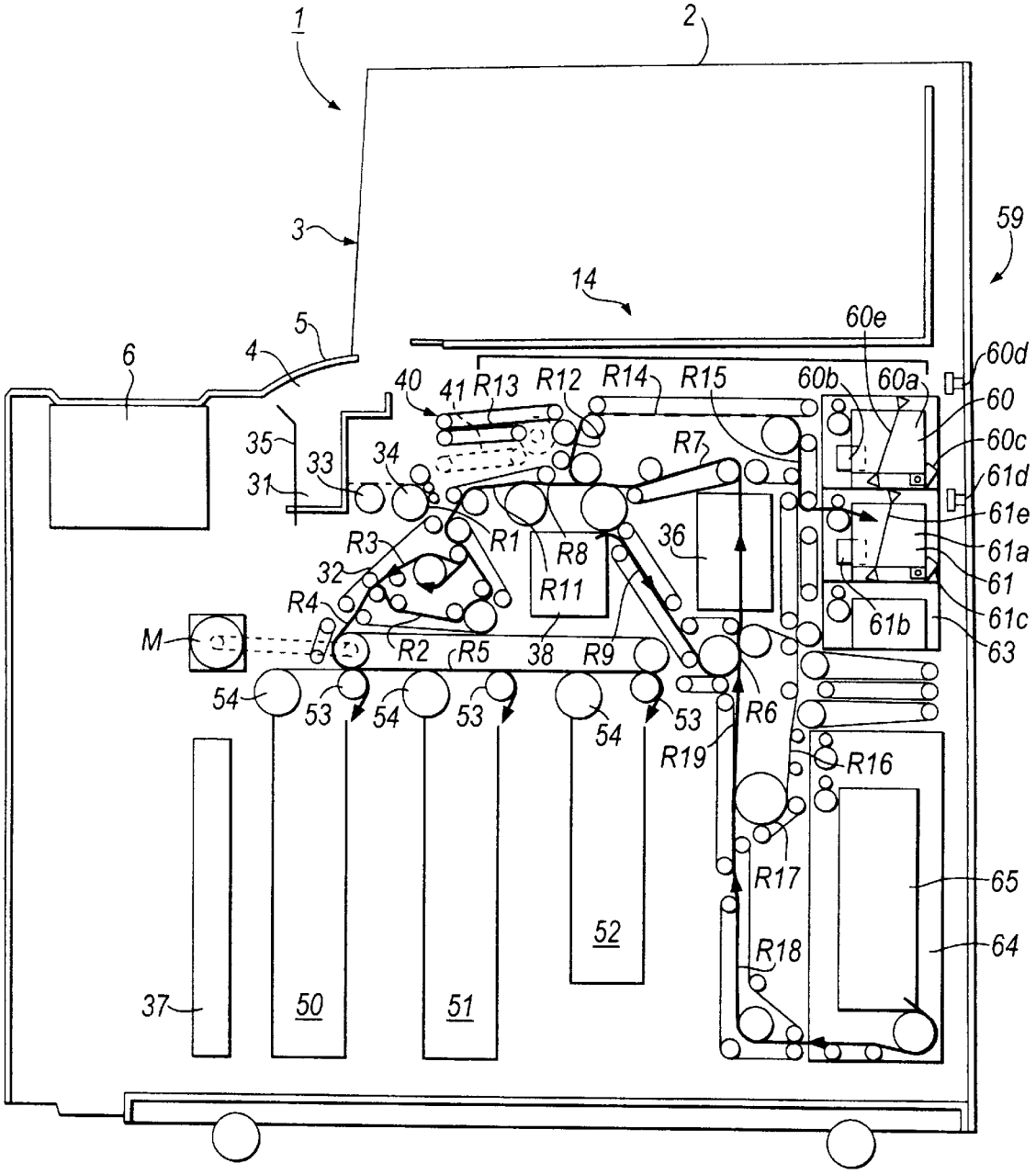
FIG. 8 is a schematic diagram showing the flow of bank-notes following the flow of banknotes during the checking in the automatic transaction apparatus shown in FIG. 7.

FIG. 7 and FIG. 8 are schematic diagrams showing the flow of banknotes during the banknote check in the automatic transaction apparatus. Further, FIG. 8 shows the flow of banknotes following the flow shown in FIG. 7.

If a check instruction is transmitted from a host computer; that is, a control center via the transmission controller 20, it is confirmed that the depositing/dispensing apparatus 1 is not in either the depositing and dispensing operation and the well known check is started by the control of the main controller 11.

As shown in FIG. 7, banknotes P stared in the first through the third safes 50 through 52 are taken out to the convey path R5 via the banknote take-out device 54 and the banknote take-in device 53 arranged corresponding to respective safes, conveyed in order by the convey paths R5–R7, R12 and R14–R16 and stored in the loading cassette 65 of the auxiliary safe 64.

At this time, banknotes stored in respective safes are classified, rejected by the inspection unit 36 for the reason of more than two sheets being conveyed in the overlapped state, tear or damage and branched at the convey path R15, and stored in the rejected banknote cassette 60*a* of the first rejected banknote storage box 60, one of the pre-decided first and the second rejected banknote storage boxes 60 and 61, in which ¥5000 banknotes and rejected banknotes for dispensing are already stored as shown by the broken line with arrows.

Then, the banknotes P stored in the auxiliary safe 64 are returned to the original safes in order via the convey paths R18, R19, R6–R8, R11 and R1–R5 as shown in FIG. 8.

At this time, while banknotes which already passed through the inspection unit 36, stored in the auxiliary safe 64 and taken out of the auxiliary safe 64 again and passed once more through the inspection unit 36 are sent to the auxiliary safe 64 from respective safes, banknotes of which number of sheets could not be judged as they were overlapped in more than two sheets and torn or damaged banknotes may be generated. These banknotes are rejected by the inspection unit 36 and stored in the rejected banknote cassette 60*a* of the first rejected banknote storage box 60 in which ¥5000 banknotes, rejected banknotes after received and rejected banknotes for dispensing before the check are already stored.

On the contrary, rejected banknotes generated from dispensing after the time when the balance of recycle banknotes secured for dispensing in response to dispensing requests by the "Check" described above or rejected banknotes generated from the depositing in the continued customer transactions; that is, rejected banknotes for dispensing after the check and rejected banknotes for depositing after the check are stored in an unused rejected banknote storage box in the first and the second rejected banknote storage boxes 60 and 61; that is, the rejected banknote cassette 61*a* of the second rejected banknote storage box 61 in this embodiment as shown in FIG. 8.

Further, in a circulation type automatic transaction apparatus (generally, requiring no auxiliary safe) with a banknote take-out device to take out recycle banknotes storing in the recycle banknote storage box provided at the exit side opposite to a banknote take-in device provided at the inlet side; the embodiment of the present invention described above is applicable if rejected banknotes for dispensing after the check and rejected banknotes for depositing after the check are stored in either one of the first and the second rejected banknote storage boxes in which ¥5000 banknotes (exclusive banknotes), etc. that are not used for dispensing are already stored.

Accordingly, new rejected banknotes generated during the customer transactions such as dispensing or depositing after completing the check are clearly discriminated from rejected banknotes rejected before the check and those generated during the check. Thus, it becomes possible to recover rejected banknotes generated before the check at any timing separated from the execution of check after instructing automatic transaction apparatus arranged in, for instance, remote unattended shops to perform the automatic check.

On the other hand, rejected banknotes other than new rejected banknotes generated after the check can be recovered in a short time by recovering a rejected banknote cassette corresponding to the first or the second rejected banknote storage box. In this case, as a rejected banknote storage box storing rejected banknotes generated before the check is reported to the outside; that is, a touring clerk by a display provided at the outside of the rejected banknote storage box, it is possible to prevent that the number of rejected banknotes generated from recycle banknotes already counted as the balance in the recycle banknote section after the check is erroneously counted.

Further, as each of the rejected banknote storage boxes is provided with an independent lock key, the rejected banknote storage boxes that are opened by a touring clerk during the tour is restricted to the minimum required and thus, security is ensured. Further, rejected banknotes are recovered by exchanging a cassette loaded in a rejected banknote storage box in the main body with a spare cassette formed substantially in the same shape and therefore, the possibility for erroneous loss of rejected banknotes by the recovery work is reduced. In this case, as errors resulting from the recovery work are prevented by a banknote detecting sensor and a cassette detecting sensor to detect empty of a spare cassette and setting of a spare cassette, the work efficiency is promoted and it is also prevented an automatic transaction apparatus from being stopped undesirably because of defects or residual banknotes in a replaced rejected banknote cassette.

Figure 9:
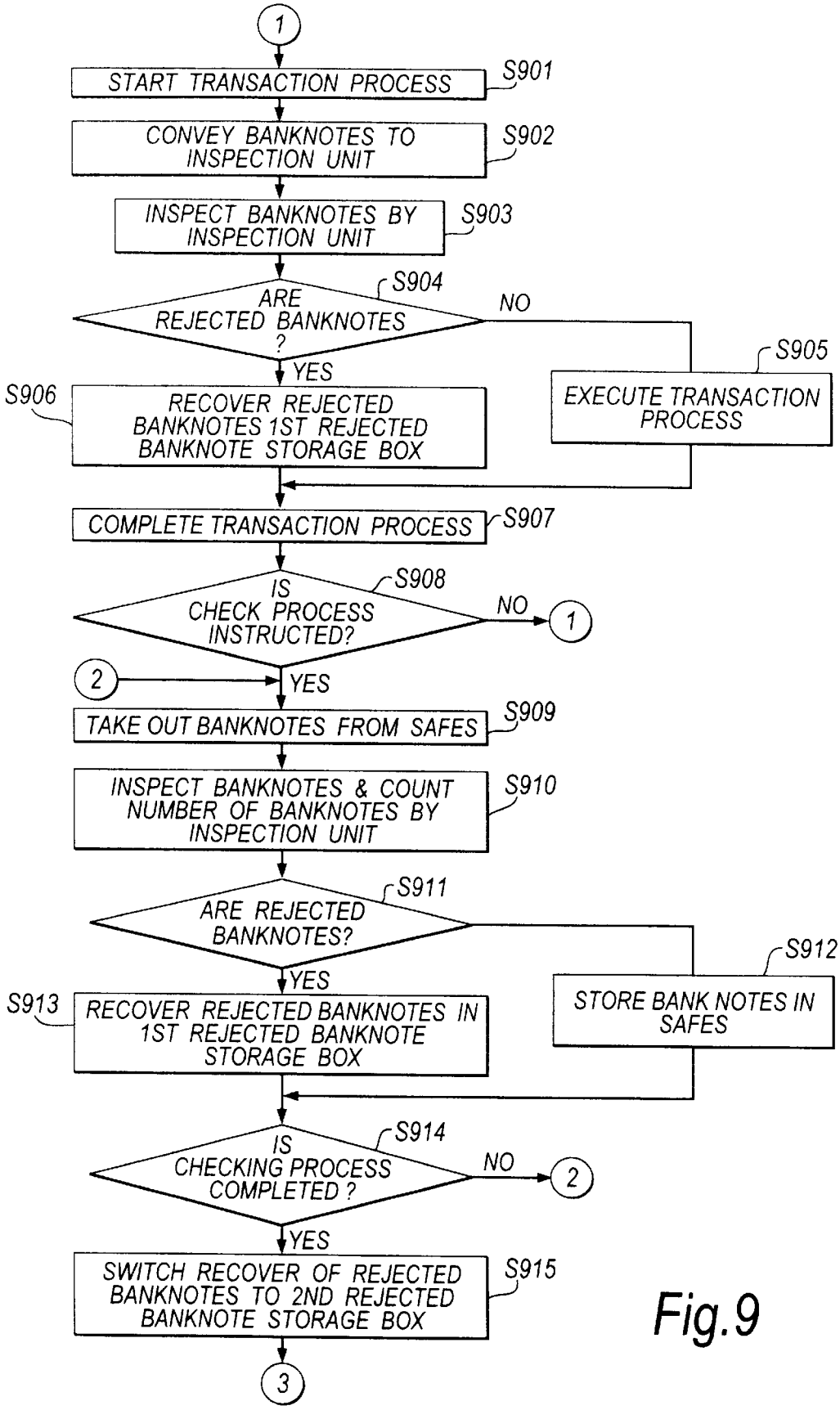
FIG. 9 is a flowchart for explaining the operation to recover rejected banknotes in the first and the second rejected banknote storage boxes.
Figure 9:
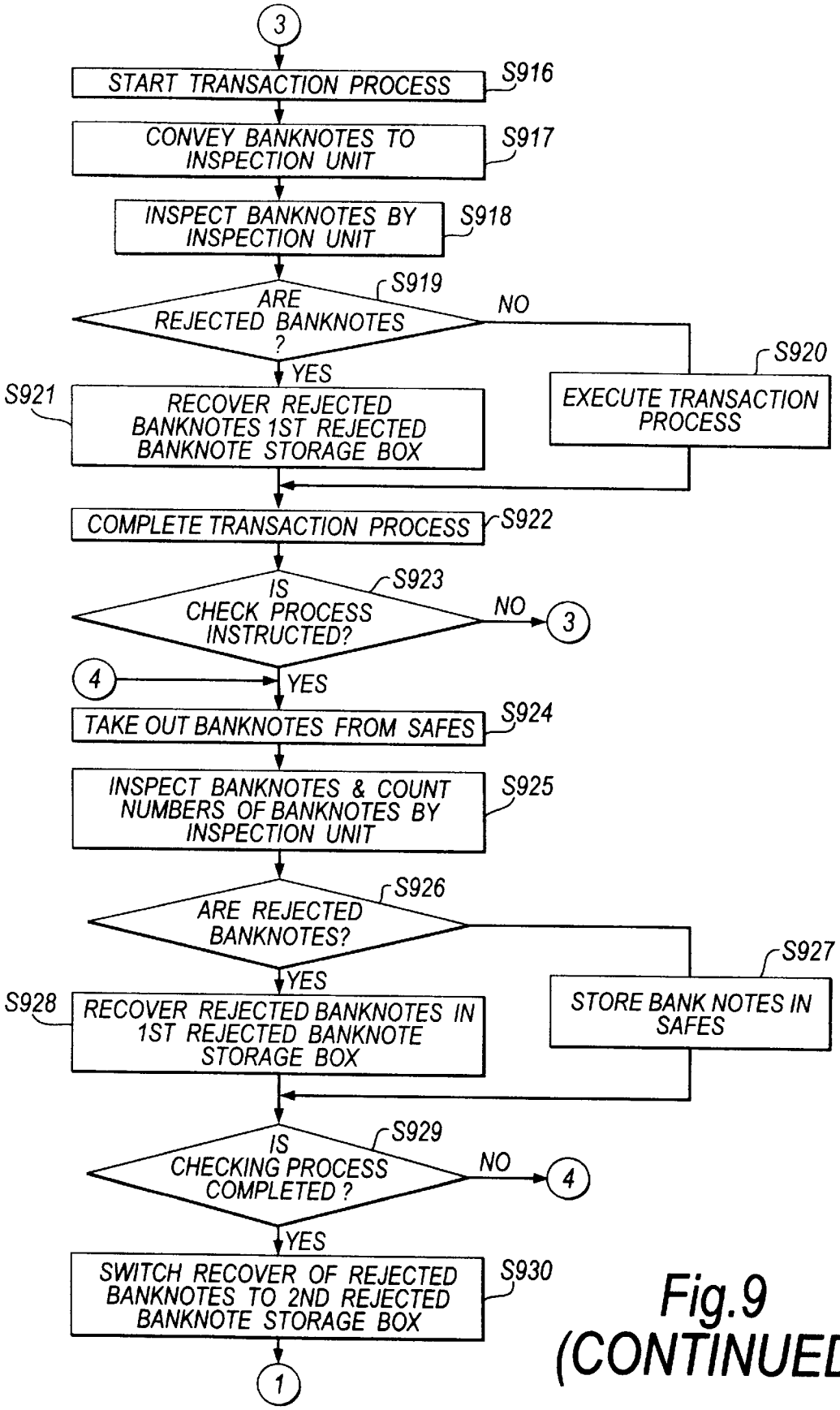

Next, the operation to recover rejected banknotes generated in the depositing/dispensing transactions and the check under the control of the main controller 11 in the first and the second rejected banknote storage boxes will be described referring to the flowchart shown in FIG. 9.

User starts a transaction process by selecting either the depositing or dispensing transaction via the customer reception unit 16 (S901). In case of the depositing transaction, user puts banknotes into the hopper 31 collectively through the banknote receiving/dispensing opening 4. In case of the dispensing transaction, user inputs a dispensing amount through the control key displayed on the CRT display of the customer reception unit 16. Deposited banknotes are conveyed toward the inspection unit 36. In case of the dispensing transaction, banknotes in the number of sheets corresponding to the input dispensing amount are taken out of the first through the third safes 50 through 52 and conveyed toward the inspection unit 36 (S902). The banknotes conveyed to the inspection unit 36 are inspected by the inspection unit 36 as to whether they are uncountable because of more than two sheets of banknotes conveyed in the overlapped state or not suited for reuse because of remarkable stain and/or damage (S903 and S904).

In Step S904, if banknotes judged by the inspection unit 36 are not rejected banknotes (S904: NO), the transaction process is executed (S905). That is, in case of the depositing transaction, deposited banknotes are stored in the first through the third safes by kind and the transaction process is completed (S907). In case of the dispensing transaction, banknotes passed through the inspection unit 36 are conveyed to the hopper 31 of the banknote receiving/dispensing opening 4 and paid to user.

In Step S904, when banknotes judged by the inspection unit 36 are rejected banknotes (S904: YES), these banknotes are recovered in the first rejected banknote storage box 60 (S906).

After completing the transaction process, it is judged whether there was an instruction for the checking process from a host computer via the transmission controller 20 (S908). If there was no instruction for the checking process (S908: NO), the process returns to Step S901. If there was an instruction for the checking process (S908: YES), banknotes stored in the first through the third safes 50 through 52 are taken out to the convey path (S909). The banknotes taken out to the convey path are conveyed to the inspection unit 36 and inspected by the inspection unit 36 as to whether they are rejected banknotes not suited for reuse as they are uncountable because more than two sheets are being overlapped or remarkably contaminated or damaged. At the same time, the number of banknotes normally conveyed are counted by this inspection unit 36 (S910 and S911).

In Step 911, if banknotes judged by the inspection unit 36 are not rejected banknotes (S911: NO), the banknotes are returned again to the first through the third safes 50 through 52 by kind (S912).

In Step 911, if banknotes judged by the inspection unit 36 are rejected banknotes (S911: YES), these rejected banknotes are recovered in the first rejected banknote storage box 60 (S913).

In Step S914, it is judged whether all banknotes are stored in the safes (S912) or rejected banknotes are recovered in the first rejected banknote storage box 60 and the checking process was completed. If the checking process was not completed (S914: NO), the process returns to Step S909.

When the checking process is completed (S914: YES), the recovery of rejected banknotes is switched from the first rejected banknote storage box 60 to the second rejected banknote storage box 61 (S915).

When the rejected banknote storage box is switched to the second rejected banknote storage box 61, the transaction process becomes possible again.

That is, user starts the transaction process by selecting either the depositing or dispensing transaction via the customer reception unit 16 (S916). In case of the depositing transaction, user puts banknotes collectively in the hopper 31 through the banknote receiving/dispensing opening 4. In case of the dispensing transaction, user inputs a dispensing amount through the control keys displayed on the CRT display of the customer reception unit 16. The deposited banknotes are conveyed to the inspection unit 36. In case of the dispensing transaction, banknotes in the number of sheets corresponding to the input dispensing amount are taken out of the first through the third safes 50 through 52 and conveyed to the inspection unit 36 (S917). The banknotes conveyed to the inspection unit 36 are judged as to whether they are uncountable because of more than two sheets conveyed in the overlapped state or remarkable contamination or damage and not suited for reuse by the inspection unit 36 (S918 and S919).

In Step 919, if the banknotes judged by the inspection unit 36 are not rejected banknotes (S919: NO), the transaction process is executed (S920). That is, in case of the depositing transaction, deposited banknotes are stored in the first through the third safes by kind and the transaction process is completed (S922). In case of the dispensing transaction, banknotes passed through the inspection unit 36 are conveyed to the hopper 31 of the banknote receiving/dispensing opening 4 and paid to user.

In Step S919, if the banknotes judged by the inspection unit 36 are rejected banknotes (S919: YES), these banknotes are recovered in the second rejected banknote storage box 61 (S921).

After completing the transaction process, it is judged whether there was an instruction for the checking process from a host computer via the transmission controller 20 (S923). If there was no instruction for the checking process (S923: NO), the process returns to Step S916. If there was an instruction for the checking process (S923: YES), banknotes stored in the first through the third safes 50 through 52 are taken out to the convey paths, respectively (S924). The banknotes taken out to the convey paths are conveyed to the inspection unit 36 and judged by this inspection unit 36 as to whether they are rejected banknotes not suited for reuse because they are uncountable due to more than two sheets conveyed in the overlapped state or remarkably contaminated or damaged. At the same time, the number of banknotes normally conveyed are counted by this inspection unit 36 (S925 and S926).

In Step 926, if banknotes judged by the inspection unit 36 are not rejected banknotes (S926: NO), they are returned again to the first through the third safes 50 through 52 by kind (S927).

In Step S926, if banknotes judged by the inspection unit 36 are rejected banknotes (S926: YES), these rejected banknotes are recovered in the second rejected banknote storage box 61 (S928).

In Step S929 it is judged whether all banknotes are stored in the safes (S927) or rejected banknotes are recovered in the second rejected banknote storage box 61 and the checking process is completed. If the checking process was not completed (S929: NO), the process returns to Step S924.

If the checking process was completed (S929: YES), the recovery of rejected banknotes is switched from the second rejected banknote storage box 61 to the first rejected banknote storage box 60 by the main controller 11 (S930).

When the rejected banknote storage box is switched to the first rejected banknote storage box 60, the transaction process becomes possible again.

As described above, in the automatic transaction apparatus of the present invention, banknotes rejected by the checking process which recovers banknotes in respective safes by kind of banknote by counting the number of banknotes stored in respective safes by kind of banknote, rejected banknotes rejected by the inspection of the inspection unit, and banknotes rejected by the inspection of banknotes newly deposited into the receiving opening by the inspection unit alter completing the checking process are stored in different rejected banknote storage boxes which are decided in advance. Accordingly, rejected banknotes newly rejected after completing the checking process are stored separately from rejected banknotes that are rejected before and during the checking process.

Further, according to the automatic transaction apparatus of the present invention, banknotes rejected during the checking process to count the number of banknotes stored in the respective safes by kind and recover them again in the respective safes by kind, banknotes rejected by the inspection of the inspection unit, banknotes rejected by the inspection of the inspection unit from those banknotes newly deposited in the receiving opening after confirming the balance in the checking process, and rejected banknotes generated in the dispensing transaction after the checking process are stored separately from rejected banknotes that are rejected before and during the check. At the same time, rejected banknotes that were rejected before and the during the check can he taken out to the outside of the apparatus at any timing.

Further, according to the automatic transaction apparatus of the present invention, the first and the second rejected banknote storage boxes contain the rejected banknote cassettes formed in the mutually exchangeable shape for each rejected banknote storage box, rejected banknotes that are newly rejected after completing the checking process are stored separately from those banknotes rejected before and during the check, and a desired rejected banknote cassette can be detached/attached at any timing. Accordingly, a time required for recovering rejected banknotes is reduced. Further, as rejected banknotes can be conveyed in the state stored in the cassette, security is improved. Furthermore, cassettes set in the first and the second rejected banknote storage boxes reduce the number of cassettes for exchange purpose that must be retained as spares for the service.

Thus, the automatic transaction apparatus can be operated continuously without removing rejected banknotes stored in the rejected banknote stacking section at the time when the balance is confirmed by the checking process.

Further, the touring time required by a touring clerk are no longer restricted. Accordingly, a service man is required only to exchange an empty reject banknote cassette with the rejected banknote cassette in the rejected banknote storage box of the automatic transaction apparatus and is able to recover either one or both of rejected banknotes before the check or rejected banknotes generated by the check.

Further, as a time required by a touring clerk for touring on-line remote controllable unattended shops is reduced and thus, touring efficiency of touring clerks is increased.

What is claimed is:

1. An automatic transaction apparatus for performing a transaction process for banknotes, the apparatus comprising:

a banknote storage device configured to store banknotes to be transacted;

an inspection unit positioned and configured to inspect (1) banknotes removed from said banknote storage device during the transaction process and (2) banknotes stored in the banknote storage device during a checking process in which the banknotes stored in the banknote storage device are classified into normal banknotes and rejected banknotes, and a quantity of the normal banknotes are counted;

a first rejected banknote storage box and a second rejected banknote storage box, said banknote storage boxes being constructed and arranged to store banknotes judged to be rejected by the inspection unit during the transaction process and the checking process; and a controller configured to switch between the first and the second rejected banknote storage boxes after completing the checking process to discriminate between (1) a rejected banknote storage box storing banknotes judged to be rejected during a transaction process occurring before the checking process and banknotes judged to be rejected during the checking process, and (2) a rejected banknote storage box storing banknotes judged to be rejected during a transaction process occurring after completing the checking process and banknotes judged to be rejected during the next checking process.

2. An automatic transaction apparatus as claimed in claim 1, further comprising:

an indicator configured to identify (1) the rejected banknote storage box storing the banknotes judged to be rejected during the transaction process occurring before the checking process and the banknotes judged to be rejected during the checking process, and (2) the rejected banknote storage box storing the banknotes judged to be rejected during the transaction process after completing the checking process and the banknotes judged to be rejected during the next checking process in such a manner that the banknote storage boxes can be discriminated from one another.

3. An automatic transaction apparatus as claimed in claim 1 further comprising a main body, the first rejected banknote storage box having a first rejected banknote cassette removably attached to the main body, said first rejected banknote cassette being provided with a first lock key to removably attach the first rejected banknote cassette to the main body, and the second rejected banknote storage box having a second rejected banknote cassette removably attached to the main body, said second rejected banknote cassette being provided with a second lock key to removably attach the second rejected banknote cassette to the main body, wherein both the first and the second rejected banknote storage boxes being independently removably attachable to the main body.

4. An automatic transaction apparatus as claimed in claim 3, further comprising:

a detection device means for detecting the attached state of the first and the second rejected banknote storage boxes.

5. An automatic transaction apparatus as claimed in claim 1, wherein the first rejected banknote storage box has a first sensor to detect whether banknotes are stored in the first rejected banknote storage box and the second rejected banknote storage box has a second sensor to detect whether banknotes are stored in the second rejected banknote storage box.

6. An automatic transaction apparatus as claimed in claim 1, wherein the first and the second rejected banknote storage boxes are formed in the same shape and both the first and the second rejected banknote storage boxes are interchangeable each other.

7. An automatic transaction apparatus for performing the dispensing transaction of banknotes, comprising:

a banknote storage device configured to store banknotes for a dispensing transaction;

a dispensing device configured to dispense the banknotes stored in the banknote storage device;

an inspection unit positioned and configured to inspect (1) banknotes removed from said banknote storage device during the dispensing transaction and (2) banknotes stored in the banknote storage device during a checking process in which the banknotes stored in the banknote storage device are classified into normal banknotes and rejected banknotes, and a quantity of the normal banknotes are counted;

a first rejected banknote storage box and a second rejected banknote storage box, said banknote storage boxes being constructed and arranged to store banknotes judged to be rejected by the inspection unit during the dispensing transaction and the checking process;

a controller configured to switch between the first and second rejected banknote storage boxes after completing the checking process to discriminate between (1) a rejected banknote storage box storing banknotes judged to be rejected during the dispensing transaction occurring before the checking process and banknotes judged to be rejected during the checking process, and (2) a rejected banknote storage box storing banknotes judged to be rejected during the dispensing transaction occurring after completing the checking process and banknotes judged to be rejected during the next checking process a first conveyor device constructed and arranged to convey the banknotes judged to be normal by the inspection unit to the dispensing device during the dispensing transaction; and a second conveyer device constructed and arranged to convey the banknotes judged to be normal by the inspection unit to the banknote storage device during the checking process.

8. An automatic transaction apparatus for performing a depositing transaction and a dispensing transaction of banknotes, comprising:

a banknote receiving device configured to receive banknotes to be deposited;

a dispensing device configured to dispense banknotes;

a banknote storage device configured to store the banknotes received by the banknote receiving device, the stored banknotes in the banknote storage device being stored for use as dispensing banknotes;

an inspection unit constructed and arranged to inspect (1) the banknotes received by the banknote receiving device during the depositing transaction, (2) banknotes removed from the banknote storage device during the dispensing transaction, and (3) banknotes stored in the banknote storage device during a checking process in which the banknotes stored in the banknote storage device are classified into normal banknotes and rejected banknotes, and a quantity of the normal banknotes are counted;

a depositing rejected banknote storage section constructed and arranged to store banknotes received by the banknote receiving device and judged to be rejected by the inspection unit during the depositing transaction;

a first dispensing rejected banknote storage box and a second dispensing rejected banknote storage box, said dispensing rejected banknote storage boxes being configured to store banknotes judged to be rejected by the inspection unit during the dispensing transaction and the checking process; and a controller configured to switch between the first and second dispensing rejected banknote storage boxes after completing the checking process to discriminate between (1) a dispensing rejected banknote storage box storing banknotes judged to be rejected during the dispensing transaction occurring before the checking process and banknotes judged to be rejected during the checking process, and (2) a dispensing rejected banknote storage box storing banknotes judged to be rejected during the dispensing transaction occurring after completing the checking process and banknotes judged to be rejected during the next checking process.

9. An automatic transaction apparatus as claimed in claim 8, further comprising:

an indicator configured to identify (1) the dispensing rejected banknote storage box storing the banknotes judged to be rejected during the dispensing transaction occurring before the checking process and the banknotes judged to be rejected during the checking process, and (2) the dispensing rejected banknote storage box storing the banknotes judged to be rejected during the dispensing transaction occurring after completing the checking process and the banknotes judged to be rejected during the next checking process in such a manner that the dispensing banknote storage boxes can be discriminated from one another.

10. An automatic transaction apparatus as claimed in claim 8 further comprising a main body, the first dispensing rejected banknote storage box having a first rejected banknote cassette removably attached to the main body, said first rejected banknote cassette being provided with a first lock key to removably attach the first rejected banknote cassette to the main body, and the second dispensing rejected banknote storage box having a second rejected banknote cassette removably attached to the main body, said second rejected banknote cassette being provided with a second lock key to removably attach the second rejected banknote cassette to the main body, wherein both the first and the second rejected banknote storage boxes being independently removably attachable to the main body.

11. An automatic transaction apparatus as claimed in claim 10, further comprising:

a detection device for detecting the attached state of the first and the second dispensing rejected banknote storage boxes.

12. An automatic transaction apparatus as claimed in claim 8, wherein the first dispensing rejected banknote storage box has a first sensor to detect whether banknotes are stored in the first dispensing rejected banknote storage box and the second dispensing rejected banknote storage box has a second sensor to detect whether banknotes are stored in the second dispensing rejected banknote storage box.

13. An automatic transaction apparatus as claimed in claim 8, wherein the first and the second dispensing rejected banknote storage boxes are formed in the same shape and both the first and the second dispensing rejected banknote storage boxes are interchangeable each other.

14. An automatic transaction apparatus for performing a depositing transaction and a dispensing transaction of banknotes, said apparatus comprising:

a banknote receiving device configured to receive banknotes to be deposited;

a banknote dispensing device configured to dispense banknotes;

a banknote storage device configured to store banknotes received by the banknote receiving device, the stored banknotes in the banknote storage device being stored for use as dispensing banknotes;

an inspection unit constructed and arranged to inspect (1) banknotes received by the banknote receiving device during the depositing transaction, (2) banknotes removed from the banknote storage device during the dispensing transaction, and (3) banknotes stored in the banknote storage device during a checking process in which the banknotes stored in the banknote storage device are classified into normal banknotes and rejected banknotes, and a quantity of the normal banknotes are counted;

a depositing rejected banknote storage section configured to store banknotes received by the banknote receiving device and judged to be rejected by the inspection unit during the depositing transaction;

a first dispensing banknote storage box and a second dispensing rejected banknote storage box, said dispensing banknote storage boxes being constructed and arranged to store banknotes judged to be rejected by the inspection unit during the dispensing transaction and the checking process;

a controller configured to switch between the first and second rejected banknote storage boxes after completing the checking process to discriminate between (1) a rejected banknote storage box storing banknotes judged to be rejected during the dispensing transaction occurring before the checking process and banknotes judged to be rejected during the checking process, and (2) a rejected banknote storage box storing banknotes judged to be rejected during the dispensing transaction occurring after completing the checking process and banknotes judged to be rejected during the next checking process a first conveyer device constructed and arranged to convey the banknotes judged to be normal by the inspection unit to the dispensing device during the dispensing transaction; and a second conveyer device constructed and arranged to convey the banknotes judged to be normal by the inspection unit to the banknote storage device during the deposition transaction and the checking process.

15. A rejected banknote storing method in an automatic transaction apparatus for performing a banknote transaction process, the method comprising the steps of:

storing banknotes judged to be rejected by an inspection unit during the banknote transaction process in a first rejected banknote storage box;

storing banknotes in the first rejected banknote storage box which are judged to be rejected by the inspection unit during a checking process in which the banknotes stored in safes for the transaction process are classified into normal and rejected banknotes, and a quantity of the normal banknotes are counted; and storing banknotes in a second rejected banknote storage box different from the first rejected banknote storage box which are judged to be rejected by the inspection unit during a next transaction process which occurs after completing the checking process.

16. A rejected banknote storing method in an automatic transaction apparatus for performing a depositing transaction process and a dispensing transaction process, the method comprising the steps of:

storing banknotes judged to be rejected by an inspection unit during the depositing transaction process in a rejected banknote storage section;

storing (1) banknotes judged to be rejected during the dispensing transaction process occurring before a checking process and (2) banknotes judged to be rejected during the checking process in a first dispensing rejected banknote storage box; and storing (1) banknotes judged to be rejected during the dispensing transaction process occurring after completing the checking process and (2) banknotes judged to be rejected during a next checking process in a second dispensing rejected banknote storage box.

* * * * *